US011592150B1

(12) United States Patent
Xu

(10) Patent No.: US 11,592,150 B1
(45) Date of Patent: Feb. 28, 2023

(54) BENDABLE AND POSEABLE DECORATIVE LAMP

(71) Applicant: GUANGDONG MINGLUN OPTOELECTRONICS TECHNOLOGY CO., LTD., Guangdong Province (CN)

(72) Inventor: Yiqun Xu, Guangdong Province (CN)

(73) Assignee: GUANGDONG MINGLUN OPTOELECTRONICS TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/837,244

(22) Filed: Jun. 10, 2022

(30) Foreign Application Priority Data

Nov. 2, 2021 (CN) ..... 202111290538.7

(51) Int. Cl.
*F21S 4/26* (2016.01)
*F21V 23/06* (2006.01)
*F21Y 103/10* (2016.01)

(52) U.S. Cl.
CPC ..... *F21S 4/26* (2016.01); *F21V 23/06* (2013.01); *F21Y 2103/10* (2016.08)

(58) Field of Classification Search
CPC ..... F21Y 2103/10; F21V 23/06; F21S 4/26; F21S 4/20; F21S 4/24; F21S 4/22
See application file for complete search history.

(56) References Cited

U.S. PATENT DOCUMENTS 6,547,418 B1 * 4/2003 Hsu ..... F21S 4/26 362/249.14
10,876,689 B1 * 12/2020 Bowser ..... F21V 9/30
2011/0062888 A1 * 3/2011 Bondy ..... H05B 45/10 315/294

* cited by examiner

*Primary Examiner* — Anabel Ton
(74) *Attorney, Agent, or Firm* — Michael Ye; Rimon Law

(57) ABSTRACT

The present invention relates to a bendable decorative lamp, at least comprising: a plurality of segmental light-emitting bodies that are independent of each other, wherein each said segmental light-emitting body has an elastically bendable transparent tube, a flexible strip light having a plurality of light-emitting cells, and a spring steel band that is integrally formed, and the transparent tube radially wraps therein the strip light and the spring steel band that are arranged in parallel to each other, wherein the segmental light-emitting bodies are mechanically separated from each other and electrically connected to each other.

13 Claims, 4 Drawing Sheets

BENDABLE AND POSEABLE DECORATIVE LAMP

This application claims the benefit of the Chinese Patent Application No. CN 202111290538.7 filed on Nov. 2, 2021, and Chinese Patent Application No. CN 202122659528.8 filed on Nov. 2, 2021, which is hereby incorporated by reference as if fully set forth herein.

BACKGROUND OF THE INVENTION

1. Technical Field

The present invention relates to the technical field of lighting fixtures, particularly to a bendable and poseable decorative lamp.

2. Description of Related Art

With the rapid social and economic development, LED lamps as a powerful tool for campaign and decoration have become an essential part of urban scenery to advertise businesses and embellish cities. LED copper-wire strip lights represent a novel type of power-saving, environmentally friendly, decorative lamp manufactured by soldering individual light-emitting diodes onto copper wires, and have been used in various scenes for decoration, such as building exterior, house interior, parts, plazas, etc.

LEDs form a light source superior to the traditional light sources in many aspects as they are less heating, more controllable, rich in color rendering. These advantages make it a natural trend that LEDs weed out the traditional light sources, and such a trend has incited the technical development of LED lamps. Given the fact that heat dissipation is determinative to lamps in terms of service life and performance, in an LED lamp, LEDs are usually separated by a proper distance light source. The existing LED lamp products popular among consumers are LED tubes wherein LEDs are set in a linear arrangement and planar LED lamps wherein LEDs are arranged into an array.

CN209672111U has disclosed a copper wire lamp for decoration, which solves the technical problems of some existing LED strip lights about insufficient protective measures. The prior-art device comprises conductive filaments and light-emitting sources, wherein the light-emitting sources and the conductive filaments are connected to each other, and the light-emitting sources are separately arranged in the length direction of each conductive filaments. The light-emitting sources are each encapsuled by light-permeable resin. The copper wire lamp is all-directional bendable and is installed onto a mount. When the conductive filaments are connected to a power source, the light-emitting sources emit light.

However, some existing LED lamps are still subject to at least one or more of the following issues. First, due to structural limitations, some prior-art LED lamps are not bendable and poseable at all, and even those bragging about bendability and poseability tend to lose their posed postures or become loose swayed over time. Secondary, some existing LED lamps are designed without considering scalability and have a fixed number of LEDs. As a result, they are rigid in terms of scale and less adaptive to practical use scenarios. Moreover, some known LED lamps have LEDs exposed to the exterior and left unprotected. This is unfavorable to both service life and tidiness. Furthermore, some conventional LED lamps have a less compact profile that is undesired to the air-freight and express-delivery sectors in respect of packaging and transportation. Hence, the prior art requires improvements in at least one or more of these aspects.

Further, since there is certainly discrepancy between the prior art comprehended by the applicant of this patent application and that known by the patent examiners and since there are many details and disclosures disclosed in literatures and patent documents that have been referred by the applicant during creation of the present invention not exhaustively recited here, it is to be noted that the present invention shall actually include technical features of all of these prior-art works, and the applicant reserves the right to supplement the application with technical features known in the art as support.

SUMMARY OF THE INVENTION

In view of the shortcomings in the prior art, the present invention provides a bendable decorative lamp, so as to overcome one or more of technical problems arising from the prior art.

To achieve the aforementioned objectives, the present invention discloses a bendable and poseable decorative lamp, at least comprising a plurality of segmental light-emitting bodies that are separate from each other. The segmental light-emitting body comprises an elastically bendable transparent tube, a flexible strip light having a plurality of light-emitting cells, and a spring steel band that is integrally formed; wherein the transparent tube radially inward wraps the strip light and the spring steel band that are arranged in parallel to each other, wherein the segmental light-emitting body is formed into an independent component in virtue of the transparent tube acting as its light-permeable housing, and wherein when the segmental light-emitting body is electrically connected to at least one another said segmental light-emitting body formed in the same way, the segmental light-emitting body is mechanically independent of the at least one another segmental light-emitting body. The transparent tube can provide protection to the lead, thereby buffering external impact and preventing surrounding climate and foreign articles from eroding and corroding the LEDs, while helping keep the copper wire lamp in order and tidiness.

Preferably, the strip light and the spring steel band are movably received in the transparent tube. The transparent tube is formed as an optical component that reflects and refracts light emitted by the light-emitting cells, so that a plurality of spot-like light sources formed by the light-emitting cells arranged along an axial direction of the transparent tube lights up along the axial direction substantively the entire transparent tube. The transparent tube not only protectively accommodates the lead and the LEDs, but also enhances the decorative effects of the disclosed lamp. The segmental light-emitting bodies can be bent to present an arched structure of a variable radian just by installing the spring steel band into the transparent tube, without the need of additional shaping aids, thereby keeping the overall profile of the lamp compact and saving costs.

Preferably, each of two axially opposite ends of the transparent tube is capped by a cap that forms an electronic port and a mechanical port for the segmental light-emitting body, wherein the mechanical port serves to fix the segmental light-emitting body to a surface for carrying the segmental light-emitting body, and the electronic port serves to electrically connect the segmental light-emitting body to its upstream and/or downstream segment in parallel. The inner wall of the cap abuts against the opening of the transparent tube, so that the cap can prevent the spring steel band from escaping the transparent tube. The lead hole at the end of the cap serves to fix and protect at least part of the lead exposed outside the transparent tube. Specifically, it can protect the lead from undue pulling and protect at least a part of the insulating layer of the lead from wear and tear caused by friction and erosion caused by the weather or certain substances. Secondly, when the segmental light-emitting bodies are bent and coiled for storage or transportation, the cap can prevent the spring steel band from popping out of the transparent tube due to bending deformation, and the cap abuts against the end of the spring steel band, thereby assisting the spring steel band to keep coiled.

Preferably, a pin member can be externally connected to the end of the cap and formed as a cone-shaped structure for fixing the segmental light-emitting body to the ground. On the surface of the pin member, a lead slot is provided for allowing the lead of the segmental light-emitting body to pass therethrough and come out. When the cone-shaped structure of the pin member fixes the segmental light-emitting body to the lawn, the lead can come out through the slot and get connected with another segmental light-emitting body by means of their respective ports and/or butt connector. When the pin member is inserted into the lawn, the slot and the cap are remained above the ground, so as to prevent the lead from being buried underground and subject to conditions adverse to its transmission functions. Particularly, this design protects the lead from erosion caused by moisture and acid/alkaline substances in the soil over time. In addition, when the segmental light-emitting bodies are fixed to the ground by the pin member, the radian of the final arched shape of the segmental light-emitting bodies can be different. Thus, as each the segmental light-emitting body is folded inwardly or as the two supporting ends of the segmental light-emitting body are close to each other, the load of the spring steel band also increases, especially as to the part at the two ends in contact with the cap. Due to the bending load, the two ends of the spring steel band have the tendency to spread outward, that is, to generate bending stress radially upward or outward, so that the pin member needs to bear the force exerted by the end of the spring steel band. The inner wall of the pin member, especially its part indirectly relying on the spring steel band, will provide resistance force against this bending stress when being inserted into the ground, so that the posed shape is maintained. The interaction force between the pin member and the spring steel band will fasten the transparent tube, so that the transparent tube will not undergo deformation and/or shedding of the sleeve due to twisting of the segmental light-emitting bodies in two directions that are not in the same plane.

Preferably, the segmental light-emitting body has a lead terminated with a butt connector for electrically connecting the segmental light-emitting body to at least one another said segmental light-emitting body. The decorative lamp of the present invention splits a relatively long strip light into several separate units that each can work independently. Thereby, the present invention has advantages over the prior art. First, the segmental light-emitting bodies are configured to be easily assembled for use and disassembled for storage while minimizing undesired entwining as seen with the prior-art long light strips. Second, the segmental structure facilitates repair and maintenance of the lamp. In a conventional serial-connection lighting circuit, any broken node in the can make the whole lamp fail. Differently, in the present invention, the plural segmental light-emitting bodies connected parallelly and driven independently can be easily repaired by replacing the broken part with a healthy unit, and can be selectively operated to provide different lighting modes.

Preferably, the decorative lamp further comprises an electronic control unit that is provided at one end of the plural mechanically independent, electrically parallelly connected segmental light-emitting bodies and has a power supply portion and a controller, wherein the power supply portion is configured to power the light-emitting cells of each said segmental light-emitting body in a parallel-connection manner; and the controller is configured to control each of the light-emitting cells electrically connected in parallel in each said segmental light-emitting body.

Preferably, the present invention further provides a transport package for packaging a decorative lamp, wherein the segmental light-emitting bodies are such coiled and stored in the columnar transport package that the elastically bendable transparent tube and the spring steel band and the flexible strip light radially received therein can restore their initial shapes after being uncoiled. Therein, the segmental light-emitting bodies can be spirally coiled against an axis of a columnar transport package, wherein individual segmental light-emitting bodies in the columnar transport package are stacked in a tail-to-head manner to form a coil pack coaxial to the columnar transport package. Each segmental light-emitting body can be coiled into a coil which has a diameter of about 10 cm-40 cm, preferably 25 cm-35 cm, and more preferably about 30 cm.

Preferably, the segmental light-emitting body composed of the transparent tube, the strip light having the light-emitting cells, and the spring steel band has a length of 0.5 m-3 m, preferably 1 m-2.5 m, and more preferably 1.5 m-2 m.

Preferably, the transparent tube has a diameter that is greater than a diameter of the spring steel band, wherein the diameter of the transparent tube is 6 mm-10 mm, and preferably 8 mm, and the diameter of the spring steel band is 2 mm-4 mm, and preferably 3.5 mm. Thereby, with the three-point "mutual pressing" between the spring steel band and the transparent tube, there will be a large contact friction therebetween, which greatly reduces the probability of relative sliding between the spring steel band and the transparent tube, and increases the posing effect of the segmental light-emitting body caused by the spring steel band. At the same time, it can prevent the light-emitting cells and the lead from shaking due to outdoor wind blowing into the transparent tube, resulting in obvious shaking of the overall decoration or lighting effect. Further, the purpose of the relatively stable pose can be achieved only by the three-point "mutual pressing", without the need that the spring steel band and the transparent tube fully or at least partially contact with each other to provide contact friction therebetween. If there is too much contact part between the spring steel band and the transparent tube, then the spring steel band will form light interference in the part in contact with the transparent tube, and the light coverage area/surface that should be formed in the contact part is occupied by the spring steel band, so that when viewed the segmental light-emitting body from a distance or from a certain angle, the continuous lighting effect presented by the reflection/diffuse reflection of the transparent tube is affected, especially the brightness of a certain section of the segmental light-emitting body may be significantly lower or its light colors and hues may be obviously different or inharmonious with the adjacent or spaced sections lower, thereby causing the intended decorative lighting effects ineffective.

Preferably, when being posed on a plane to be decorated, each said segmental light-emitting body can present an arched structure of a variable radian.

Preferably, the light-emitting cells are LEDs.

Preferably, any two adjacent said light-emitting cells in the transparent tube are separated by an interval not greater than 10 cm, preferably not greater than 8 cm, and more preferably not greater than 5 cm.

Preferably, the decorative lamp of the present invention can be stored in a columnar, especially hollow cylindrical, transport package, wherein the decorative lamp is bendable and comprises a plurality of separate segmental light-emitting bodies, each of which can be electrically connected to its upstream and/or downstream segment through their respective ports for cascade connection while remaining mechanically separated from each other. Preferably, each said segmental light-emitting body comprises an elastically bendable transparent tube, a flexible strip light having a plurality of light-emitting cells, and a spring steel band that is integrally formed, and the transparent tube radially inward wraps the strip light and the spring steel band arranged in parallel to each other. Preferably, the segmental light-emitting bodies are such coiled and stored in the columnar transport package that the elastically bendable transparent tube and the spring steel band and the flexible strip light radially received therein can restore their initial shapes after being uncoiled. Preferably, the segmental light-emitting bodies can be spirally coiled against an axis of a columnar transport package, wherein individual segmental light-emitting bodies in the columnar transport package are stacked in a tail-to-head manner to form a coil pack coaxial to the columnar transport package.

The present invention further provides a bendable and poseable decorative lamp, at least comprising: a plurality of composite light-emitting bodies that are separate from each other such that they can be electrically connected to each other through their respective ports and mechanically independent of each other.

Preferably, the composite light-emitting body at least comprises a transparent tube and a plurality of light-emitting cells, wherein the light-emitting cells are arranged on at least a part of a lead in the transparent tube along an extending direction of the lead, and wherein the transparent tube accommodates therein a shape-memory steel band enabling the composite light-emitting body to be bent and posed.

Preferably, the lead and the shape-memory steel band are movably received in the transparent tube.

Preferably, the shape-memory steel band enables each said composite light-emitting body, in a manner that it can be coiled and uncoiled to restore its original shape, to present an arched structure of a variable radian.

Preferably, two ends of the transparent tube are each capped by a cap, wherein the cap is at least partially capped on the end of the transparent tube, and at an end of the cap remote from the transparent tube, a lead hole is provided for allowing the lead to pass therethrough and enter the transparent tube.

Preferably, the lead is terminated with a butt connector for connecting at least one another said composite light-emitting body.

Preferably, the cap is terminated with a soil pin, wherein one end of the soil pin configured to face the ground is formed as a cone-shaped structure for fixing the composite light-emitting body to the ground.

Preferably, on the surface of the soil pin at a side remote from the ground, a lead slot is provided for allowing the lead to pass therethrough and come out.

Preferably, the decorative lamp further comprises: a power source provided at an input end of the connected composite light-emitting bodies and powering the composite light-emitting bodies in a parallel-connection manner; and a controller for controlling working states of each composite said light-emitting body.

Preferably, the transparent tube has a diameter that is greater than a diameter of the shape-memory steel band, and the transparent tube has a length that is greater than or equal to a length of the shape-memory steel band.

Preferably, the light-emitting cells are LEDs.

Preferably, any two adjacent said light-emitting cells in the transparent tube are separated by an interval not greater than 10 cm, preferably not greater than 8 cm, and more preferably not greater than 5 cm.

The above-mentioned aspects of the present invention have the following beneficial technical effects:

1. The light-emitting cells are accommodated in the transparent tube and protected from external erosion and friction-incurred wear. The transparent tube also protects a part of the lead so as to prevent the insulating layer of the lead from daily wear and tear. Additionally, the reflective and refractive effects of the transparent tube improve the lighting effects of the light sources and enhance the decorative effects of the disclosed decorative lamp;

2. The bendable shape-memory steel band installed in the transparent tube benefits from the features of shape-memory alloy, and thus helps fix the composite light-emitting bodies at the posed shapes. The shape-memory steel band, in virtue of its mechanical properties, allows the light-emitting body to be bent into and held at various arches; and 3. The two ends of the transparent tube are capped by caps, which help protect the strip light and the shape-memory steel band in the transparent tube and prevents the shape-memory steel band from sliding in or coming off the transparent tube when the transparent tube is moved or bent, thereby ensuring proper shapes and desired decorative lighting effects of the resulting lamp.

DETAILED DESCRIPTION OF THE INVENTION

The present invention will be further described in detail below with reference to the accompanying drawings.

Figure 1:
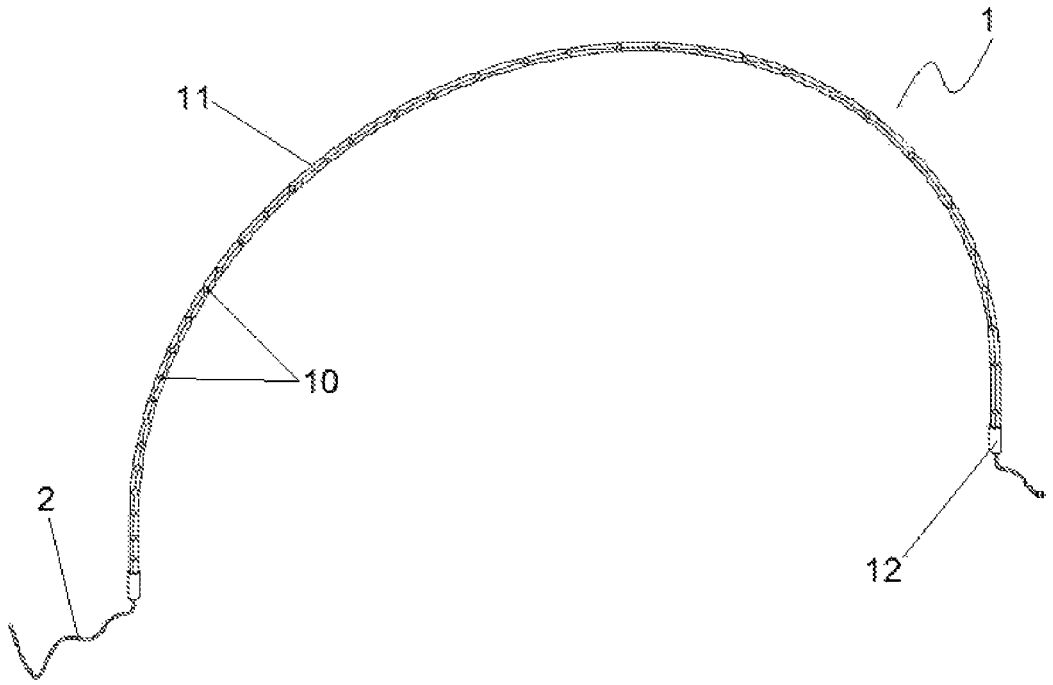
FIG. 1 is a perspective view of a preferred segmental light-emitting body according to one embodiment of the present invention.
Figure 2:
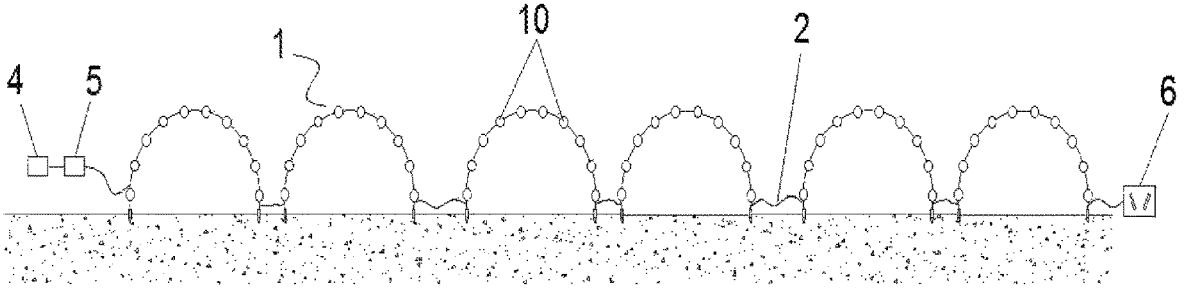
FIG. 2 is an applied view of the serially connected segmental light-emitting bodies of the embodiment of the present invention embodiment, showing preferred connection and the resulting decorative lamp posed on a plane to be decorated.

The present invention provides a bendable and poseable decorative lamp, as shown in FIG. 1, comprising a plurality of segmental light-emitting bodies 1 that can be used independently. Further, two or more segmental light-emitting bodies 1 may be connected in cascade each through a port connected to its upstream segment and a port connected to its downstream segment, respectively. Further, as shown in FIG. 2, the disclosed decorative lamp preferably has 6 serially connected segmental light-emitting bodies 1 to form a complete unit. When it is desired to have more segmental light-emitting bodies 1 connected together, two units may be connected each through a butt connector 6 at the end of its lead 2, so as to at least scale up the disclosed decorative lamp in terms of number and lighting range, thereby providing a lamp assembly that meets various decorative and illuminative needs. In use, the segmental light-emitting bodies 1 may be connected in series and fixed to the lawn like arches through fasteners.

According to one preferred mode, as shown in FIG. 1, the segmental light-emitting body 1 at least comprises a strip light composed of plural light-emitting cells 10 that are arranged along a lead 2 and separated from the adjacent cell 10 by an interval (for example, not greater than 5 cm), and a transparent tube 11 sleeved around the lead 2 and the light-emitting cells 10 for accommodating and protective purposes. Preferably, the light-emitting cells 10 may be LEDs emitting light of different colors. Specifically, the lead 2 is threaded in from one end of the transparent tube 11 and passes through the transparent tube 11 along the extending direction of the transparent tube 11 so as to get connected with at least another segmental light-emitting body 1. The transparent tube 11 surrounding the lead 2 from outside can at least provide protection to the surrounded part of the lead 2. The protection may be, for example, in the forms of buffering impact and preventing particles, dust, and other foreign articles from eroding and corroding the light-emitting cell 10. The transparent tube 11 also helps keep the lead 2 and the light-emitting cells 10 in order and tidiness. As compared to the prior art, the present invention splits a relatively long strip light into several separate units that each can work independently. Thereby, the present invention has advantages over the prior art. First, the segmental light-emitting bodies 1 are configured to be easily assembled for use and disassembled for storage while minimizing undesired entwining as seen with the prior-art long light strips. Second, the segmental structure facilitates repair and maintenance of the lamp. In a conventional serial-connection lighting circuit, any broken node in the can make the whole lamp fail. Differently, in the present invention, the plural segmental light-emitting bodies connected parallelly and driven independently can be easily repaired by replacing the broken part with a healthy unit, and can be selectively operated to provide different lighting modes.

Further, the segmental light-emitting body 1 further comprises an integrally formed spring steel band 3 radially received inside the transparent tube 11. Specifically, the transparent tube 11 radially wraps therein the strip light that is composed of the lead 2 and the light-emitting cells 10 together with a spring steel band 3, which are arranged in parallel to each other. To deploy the segmental light-emitting body 1, the springiness of spring steel band 3 allows the segmental light-emitting body 1 to be bent into an arch having a certain radian. When the segmental light-emitting body 1 has its two ends fixed into the ground, the arch can be held from deformation. Further, the strip light and the spring steel band 3 are movably received in the transparent tube 11.

Figure 4:
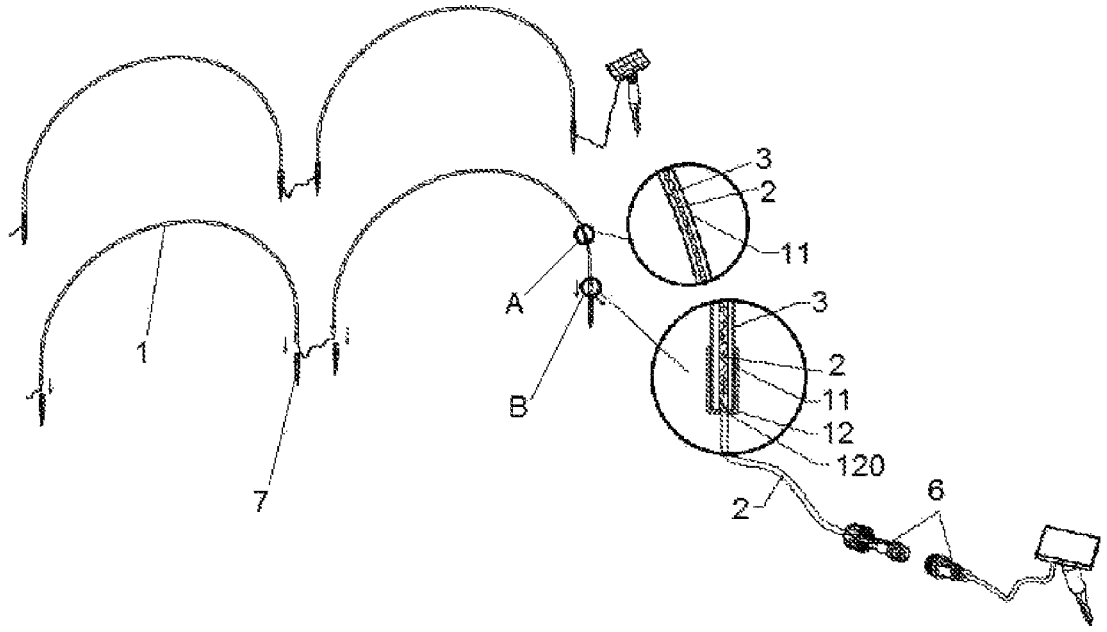
FIG. 4 is a schematic drawing illustrating serial connection of the segmental light-emitting bodies of the embodiment of the present invention, with close-up views of particular parts of the segmental light-emitting body.

According to one preferred mode, as shown in FIG. 4, since the spring steel band 3 has a diameter smaller than a half of the diameter of the transparent tube (specifically, the long spring steel has a transversely section area equal to about 0.2 of the transversely section area of the transparent tube), the segmental light-emitting body 1, particularly when bent into an arch, leaves therein a sufficient space for the spring steel band 3 to be elastically deformed, so that the arch formed by the bent spring steel band 3 and the arch formed by the bent transparent tube 11 do not coincide. Instead, the apex of the arch of the spring steel band abuts against the inner wall of the apex of the arch of the transparent tube from below (i.e., radially outward), while the two arms of the arch of the spring steel band abut against the inner wall of the two arms of the arch of the transparent tube at positions opposite to the apex. Thereby, with the three-point "mutual pressing" between the spring steel band 3 and the transparent tube 11, the relatively flexible inner wall of the transparent tube 11 yields and get deformed by the relatively rigid raised portions of the spring steel band 3 pressing thereon, so that the inner wall of the transparent tube 11 and the spring steel band 3 keep appressed against each other. As a result, when the segmental light-emitting body 1 is bent and/or posed, the mutual pressing increase contact friction therebetween, so as to better prevent the spring steel band 3 from sliding inside the transparent tube 11, and increase the posing effect of the spring steel band 3 on the segmental light-emitting body 1. This further help prevent the light-emitting cells 10 and the lead 2 in the transparent tube 11 from swaying and in turn prevent the overall decorative and/or lighting appearance from jittering when the segmental light-emitting body 1 is installed outdoors and receives strong wind.

Furthermore, such mutual pressing points the stress that is caused by the bent spring steel band 3 and act in the radial direction of the transparent tube 11 to the light-emitting cells 10, so that the light-emitting cells 10 are pressed further against the inner wall of the transparent tube 11 by the bending stress from the spring steel band 3. In other words, each of the light-emitting cells 10 is sandwiched by the spring steel band 3 and the inner wall of the transparent tube 11, thereby being firmly positioned in the transparent tube 11 and being prevented from movement. In addition, since the transparent tube 11 left therein a roomy space for components accommodated therein to move, the bending stress from the bent spring steel band 3 acts on the light-emitting cells 10 and works with the inner wall of the transparent tube 11 to hold the light-emitting cells 10 firmly. If the diameter difference between the transparent tube 11 and the spring steel band 3 is excessive large or small, the resulting excessively weak holding performance would allow the light-emitting cells 10 to undesirably move, or the resulting excessively strong holding performance would squash and damage the light-emitting cells 10.

In some alternative modes, the lead 2 and the light-emitting cells 10 may be deposited on the spring steel band 3. For example, some part of the lead 2 inside the transparent tube 11 may be wound around the periphery of the spring steel band 3, so as to fix the lead 2 and the light-emitting cells 10 firmly in the transparent tube 11, thereby preventing them from sliding/shifting inside the transparent tube 11 and preventing the redundant part of the lead 2 from entwining when individual segmental light-emitting bodies 1 are bent and/or connected to each other.

According to one preferred mode, the spring steel band 3 is diametrically smaller than the transparent tube 11 so that the spring steel band 3 can be easily threaded into the transparent tube 11. Optionally, the spring steel band 3 has a diameter of about 2 mm-4 mm, preferably 3.5 mm, and the transparent tube 11 has a diameter of about 6 mm-10 mm, preferably 8 mm. These values are determined according to actual production experience and repeated experiments. It is to be noted that if the spring steel band 3 has an excessively large diameter, the strip light composed of the lead 2 and the light-emitting cells 10 would be interfered. For example, when the spring steel band 3 is bent, the resulting bending stress generated at the spring steel band 3 would acts on the light-emitting cell 10 excessively to squash and even damage the light-emitting cells 10. Additionally, an excessively large diameter of the spring steel band 3 would affect transmission of the light reflected by the transparent tube 11 and in turn the overall lighting effects of the segmental light-emitting body 1. Moreover, the spring steel band 3 having its diameter excessively large would be limited in terms of bending capacity, which would in turn significantly limit the poseable range of the segmental light-emitting body 1. On the contrary, if the spring steel band 3 having an excessively small diameter would tend to be broken have degraded stability. Also, an excessively small diameter would make the spring steel band 3, when bent, less capable of contacting and holding the light-emitting cells 10. This means that the inner wall of the transparent tube 11 and the spring steel band 3 would be less capable of holding the light-emitting cells 10 and that the light-emitting cells 10 would tend to move in the transparent tube 11, leading to chaotic lighting effects of the assembly of the segmental light-emitting bodies 1.

Further, some existing copper wire lamps have their strip lights wrapped by transparent tubes, and some have their strip lights directly fixed to a fixture, such as a plate. It is thus clear that the scheme of the present invention about combined use of the transparent tube 11 and the spring steel band 3 is not known to the art. The reason of such a design is in view of the defects of the following inferior alternatives. If the strip light composed of the lead 2 and the light-emitting cells 10 were simply wound around the spring steel band 3, while the strip light could be shaped as desired, the light-emitting cells 10 would not have the vital protection otherwise provided by the transparent tube 11. If the light-emitting cells 10 were simply received in the transparent tube 11 without the holding effects that would be otherwise provided by the now absent spring steel band 3, it would be difficult to have the strip light stay at the posed shape. While additional components could be added to help posing the strip light, these additional components would unavoidably increase the overall volume and space occupancy of the resulting lamp. The combined use of the transparent tube 11 and the spring steel band 3 can address the defects of these inferior alternatives, and most importantly, provide desired lighting effects of the disclosed decorative lamp. Specifically, if the strip light were wound around the spring steel band 3 without using the transparent tube 11, the light-emitting cells 10, namely the LEDs, would be limited by the spring steel band 3 to a relatively small size. This is particularly disadvantageous because when view from far, the overall illumination of the strip light would be low and would look like a dotted light band formed by weak, discrete light sources, making the lighting effects barely satisfactory. On the contrary, with the transparent tube 11 wrapping the light sources, since the transparency makes the transparent tube 11 reflective and refractive, at least a part of emitted by each light-emitting cells 10 will be reflected by the inner wall of the transparent tube 11, and then bounces back and forth inside the transparent tube 11. Therefore, due to reflection/diffuse reflection provided by the inner wall of the transparent tube 11, the reflected light can form a continuous light coverage inside the transparent tube 11 on the inner wall of the transparent tube 11. Therefore, when viewed from far, the entire segmental light-emitting body 1 seems thoroughly bright. In other words, the transparent tube 11 augments the originally dotted light band into a continuous, solid light band. To sum up, the transparent tube 11 not only protectively accommodates the lead 2 and the light-emitting cells 10, but also enhances the decorative effects of the disclosed lamp. The disclosed lamp can be easily realized by installing the spring steel band 3 into the transparent tube 11, without the need of additional shaping aids, thereby keeping the overall profile of the lamp compact and saving costs.

Figure 5:
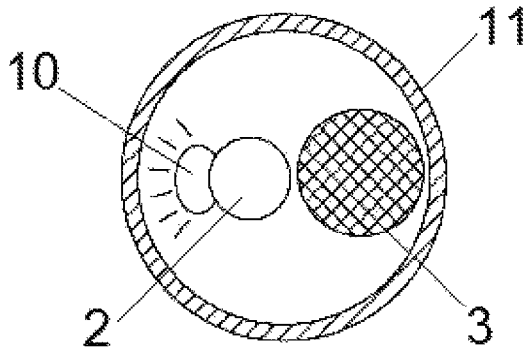
FIG. 5 is a radially cross-sectional close-up view of the segmental light-emitting body of the embodiment of the present invention taken at Part A of FIG. 4.

According to one preferred mode, the transparent tube 11 has its two axially opposite ends provided with roughly cylindrical caps 12. At the butting interface of the two components, the cap 12 has a diameter slightly greater than that of the transparent tube 11. The cap 12 at least partially sleeves the end of the transparent tube 11. Specifically, as shown in FIG. 5, the cap 12 is roughly cylindrical, and the end of the transparent tube 11 is wrapped by at least a part of the cap 12. In some other alternative embodiments, the cap 12 may be somehow elastic, so that it can bind up the transparent tube 11 and the spring steel band 3 together to prevent the spring steel band 3 from undesirably swaying inside the transparent tube 11 and degrading the resulting bendability and poseability of the segmental light-emitting body 1. Further, at an end remote to the transparent tube 11, the surface of the cap 12 is integrally formed with a flange. The flange has its surface formed with a lead hole 120 diametrically adaptive to the lead 2 for allowing the lead 2 to pass therethrough and be accommodated in the transparent tube 11. Additionally, at the end remote to the transparent tube 11, at least a part of the inner wall of the cap 12 facing the transparent tube 11 abuts against the opening of the transparent tube 11, so that the cap 12 can prevent the spring steel band 3 from escaping the transparent tube 11.

Figure 6:
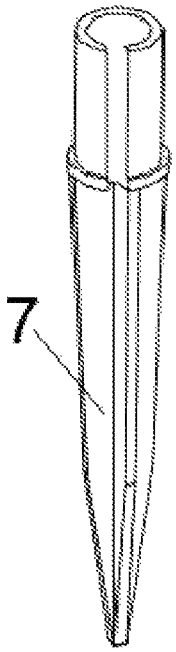
FIG. 6 is a perspective view of a pin member according to one embodiment of the present invention.

According to one preferred mode, a part of the chamber of the cap 12 at the end remote from the transparent tube 11 and the lead hole 120 at the flange jointly serve to position and protect at least part of the lead 2 exposed outside the transparent tube 11. Specifically, they can protect the lead 2 from undue pulling and protect at least a part of the insulating layer of the lead 2 from wear and tear caused by friction and erosion caused by the weather and chemicals. The segmental light-emitting bodies 1 when connected in series can be fixed to, for example, the lawn, by pin members 7 each provided at the end of the cap 12 having the flange. The cap 12 and the pin member 7 may be combined through press-fit connection. Specifically, as shown in FIG. 6, at least a part of the end of the pin member 7 close to the cap 12 is of a cylinder shape and hollow. At the butting interface of the two components, the cylinder part of the pin member 7 is diametrically greater than the cap 12, so that the end of the cap 12 can be inserted into and fixed to the pin member 7. Specifically, at the end remote from the cap 12, the pin member 7 may be formed into a roughly cone-shaped structure. In virtue of the puncture force provided by the cone-shaped structure, the segmental light-emitting body 1 can be easily inserted into the lawn and have its shape fixed by the lawn.

Further, the cylinder surface of the pin member 7 close to the cap 12 is formed with a vertical slot that allows the lead 2 to pass therethrough and come out. When the cone-shaped structure at the lower part of the pin member 7 fixes the segmental light-emitting body 1 to the lawn, the lead 2 can come out through the vertical slot and get connected with another segmental light-emitting body 1 by means of their respective ports and/or butt connectors 6. When the pin member 7 is inserted into the lawn, the vertical slot and the cap 12 are remained above the ground, so as to prevent the lead 2 from being buried underground and subject to conditions adverse to its transmission functions. Particularly, this design protects the lead 2 from erosion caused by moisture and acid/alkaline substances in the soil over time. Optionally, the pin member 7 may be integrally formed, or may alternatively be fabricated by forming separate cylinder and con-like structures and assembling them as a unity.

According to one preferred mode, the disclosed decorative lamp at least further comprises an electronic control unit installed at one end of an assembly of the segmental light-emitting bodies 1 that are mechanically independent of yet electrically connected to each other. Specifically, the electronic control unit comprises a power supply portion 4 that powers the light-emitting cells 10 of the segmental light-emitting body 1 in parallel-connection manner; and a controller 5 that controls or modulates the light-emitting cells 10 electrically connected in parallel in respective segmental light-emitting bodies 1. With this configuration, the controller 5 can control the working states or mode of the respective segmental light-emitting bodies 1. Preferably, the power supply portion 4 and the controller 5 may be integrated as a unity. Specifically, when the segmental light-emitting bodies 1 are assembled into the lamp as shown in FIG. 2, the input end of the lead 2 is connected to the power supply portion 4 and the controller 5, respectively, while the output end of the lead 2 are connected to the segmental light-emitting bodies 1 successively, wherein the individual segmental light-emitting bodies 1 are connected to each other through the ports. Further, the output end of the lead 2 of the segmental light-emitting body 1 at the tail of the decorative lamp may be provided with a butt connector 6, through which more segmental light-emitting bodies 1 may be added, so that the resulting strip light is scalable in terms of length.

Preferably, in the present invention, the segmental light-emitting body 1 has an overall length of about 0.5 m-3 m, preferably 1 m-2.5 m, and more preferably 1.5 m-2 m. For line-haul transportation, each segmental light-emitting body 1, in virtue of the spring steel band 3 in the transparent tube 11, can be spirally coiled against an axis of a columnar transport package. Therein, individual segmental light-emitting bodies in the columnar transport package are stacked in a tail-to-head manner to form a coil pack coaxial to the columnar transport package. Preferably, each segmental light-emitting body 1 can be coiled into a coil. Preferably, the coil has a diameter of about 10 cm-40 cm, preferably 25 cm-35 cm, and more preferably about 30 cm. Depending on the spring, bending capacity of the spring steel band 3, the segmental light-emitting body 1 can be coiled into a compact size to significantly reduce its space requirement during transportation, which means significantly reduced costs for packaging and handling. Particularly, a columnar container that is designed for containing the coiled segmental light-emitting bodies 1 and to be handled by manpower or a mechanical device may be made of recycle paper or thin plastic sheet that is thin and light, so as to further reduce monetary and temporal costs for handling the columnar container, and to facilitate batch handling of more columnar containers, thereby making distribution and delivery of the disclosed decorative lamps more efficiently.

Moreover, dealers in the express-delivery sector (including air freight) and related businesses have set clear requirements for the size and weight of packages to be delivered. For example, the requirements of packages from SF EXPRESS (China) for land transportation are: individual packages not exceeding 130 kg (chargeable weight) and with length, width, and height not exceeding 2.5 m, 1.0 m, and 0.8 m, respectively, and for air freight, the requirements of the company are: individual packages not exceeding 80 kg (chargeable weight) and with length, width, and height not exceeding 2.5 m, 1.5 m, and 1.5 m, respectively. As to TNT Express, the international carrier requires that individual packages not exceeding 68 kg and size not exceeding 180 cm×150 cm×120 cm. Preferably, when the segmental light-emitting body 1 of the present invention is coiled into a coil having a diameter of about 30 cm and placed into a transportation carton, the resulting size fits well in the relevant requirements from express-delivery dealers and for air freight, thereby eliminating the predicament of denied boarding and preventing safety incidents during transportation related to oversize packages. Furthermore, the spring steel band 3 has a length of about 0.5 m-3 m, and when coiled into a coil of a diameter of 10 cm-35 cm, the bending amplitude is within the elastic limit or maximum load of the spring steel band 3. Thus, when the segmental light-emitting bodies 1 are taken out from the columnar container at the transportation destination, they can fully restore their original state.

For long-haul transportation, the segmental light-emitting bodies 1 remain coiled and restricted by the columnar container for a relatively long period of time before use, also are the wires and lead inside and between individual segmental light-emitting bodies 1. Some existing decorative band lamps/strip lights are such packaged that the lamp wires are simply placed in the carton. However, these wires are likely to entwine and even unduly bent to warp over the long haul. This consequently has adverse effects on use of the band lamps/strip lights and, in extreme case, the warped wires can lead to short circuits and bring about safety concerns. Therefore, wires of band lamps/strip lights should be well arranged and fixed or jolts (such as those cause by air turbulence or rough road) of the LEDs and wires happening in transportation can make these components press and impact each other. Particularly, if the band lamps/strip lights are hauled with some bulky or heavy cargos, when the carton loaded with the coiled segmental light-emitting bodies 1 collides with any of these cargos, the strip lights are usually damaged. By contrast, the present invention uses the spring steel band 3 as the backbone of the coil pack so the columnar container loaded with the coil pack as a whole is highly resistant to external impacts. Besides, at least a part of the wires of the strip light is coiled together with the segmental light-emitting bodies 1 and radially received in the transparent tube 11, the LEDs and at least a part of the lead 2 can be effectively protected from friction, squash, and impacts among the strip lights. Also, as the wires are arranged in order, they are unlikely to entwine and unduly bend to cause damage, so that when the segmental light-emitting bodies 1 are taken out from the columnar container, the individual segmental light-emitting bodies 1 can be free of mechanical damages and circuit failures and can function normally, without any degradation of their lighting performance.

According to one preferred mode, the disclosed decorative lamp may have many working modes, which will be described with reference to FIG. 2. Specifically, a suitable number of the segmental light-emitting bodies 1 are connected in series. As shown in FIG. 2, the disclosed decorative lamp is formed by six segmental light-emitting bodies 1 connected successively through their respective leads 2 and ports from left to right. Every segmental light-emitting body 1 may be provided with, for example, thirty light-emitting cells 10. The light-emitting cells 10 are arranged separately along the lead 2 by a fixed interval. Optionally, the interval between the adjacent light-emitting cells 10 is not greater than 10 cm, preferably not greater than 8 cm, more preferably not greater than 5 cm. The light-emitting cells 10 and the lead 2 are protected and positioned by the transparent tube 11 from outside. It is to be noted that the numbers recited above are merely for specific description of exemplary working modes of the lamp of the present invention, and should not be interpreted as limitations to the possible implementations of the present invention.

According to one preferred mode, after the disclosed decorative lamp is assembled and shaped as desired, the power supply portion 4 is activated, and the decorative lamp can then be controlled and switched among different working modes by the controller 5. Preferably, the working modes of the decorative lamp may be executed by a custom control program.

Preferably, the decorative lamp has several working modes, including but not limited to the following exemplary ones. For facilitating description, the six segmental light-emitting bodies 1 are named, from left to right, as Strip Light (1), Strip Light (2), Strip Light (3), Strip Light (4), Strip Light (5), Strip Light (6)). The working modes in the present embodiments are:

Working Mode 1: All light-emitting cells 10 in Strip Light (1) are lit up from left to right successively and light constantly, and then all light-emitting cells 10 in Strip Light (2) are lit up from left to right successively and light constantly. The above process is then repeated for Strip Lights (3)-(6), until Strip Lights (1)-(6) all have been lit up and gone out and a new cycle begins;

Working Mode 2: All light-emitting cells 10 in the Strip Light (1) are lit up and light constantly, and then all light-emitting cells 10 in the Strip Light (2) are lit up and light constantly. The above process is then repeated for Strip Lights (3)-(6), until Strip Lights (1)-(6) all have been lit up and gone out and a new cycle begins;

Working Mode 3: a.k.a. Marquee Pattern 1 #, Strip Lights (1)-(6) are lit up in an alternating occulting pattern, and the respective light-emitting cells 10 of Strip Lights (1)-(6) may be lit up in an alternating occulting pattern;

Working Mode 4: a.k.a. Marquee Pattern 2 #, Strip Lights (1)-(6) are lit up from left to right successively, until Strip Lights (1)-(6) have all been lit up and then Strip Lights (1)-(6) go out from left to right successively or go out at the same time. The Strip Lights (1)-(6) are lit up from right to left successively, until Strip Lights (1)-(6) have all been lit up and then Strip Lights (1)-(6) go out from right to left successively or go out at the same time. Therein, when any of Strip Lights (1)-(6) is lit up or when all of Strip Lights (1)-(6) are lit up, a star-twinkling effect may be added (in another working mode). The foregoing sequence is repeated;

Working Mode 5: a.k.a. Marquee Pattern 3 #, Strip Light (1)-(2) are lit up at the same time and a star-twinkling effect is added. Then Strip Light (3)-(4) are lit up at the same time and a star-twinkling effect is added, until Strip Lights (1)-(6) have all been lit up, and then Strip Lights (1)-(6) go out from left to right successively. The above process is then repeated for Strip Lights (1)-(6) from right to left. After Strip Lights (1)-(6) have all been lit up, they go out from right to left;

Working Mode 6: Strip Lights (1)-(6) are all lit up at the same time without any twinkling effect.

Working Mode 7: Strip Lights (1)-(6) are all lit up at the same time with a twinkling effect.

Figure 3:
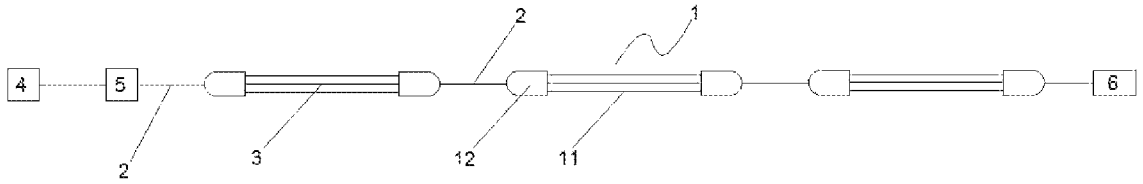
FIG. 3 is a structural diagram of the decorative lamp according to the embodiment of the present invention.

Optionally, as shown in FIG. 2 and FIG. 3, in some preferred embodiment, the transparent tube 11 and the spring steel band 3 are approximately equal in terms of length, about 1.5 m-2 m. The lead 2 between the power unit and Strip Light (1) is about 2 m long. Further, the lead 2 between each two adjacent segmental light-emitting bodies 1 is about 1.2 m-1.5 m long.

For easy understanding, the working principle and use of the bendable and poseable decorative lamp of the present invention are detailed below.

In use of the provided decorative lamp, plural segmental light-emitting bodies 1 are first connected in series according to the practical lighting and decorative needs, and then the segmental light-emitting bodies 1 are bent into arched strip lights with identical or different radians. The segmental light-emitting bodies 1 are each fixed to the lawn with pin members 7 at its two ends. The power supply portion 4 is activated, and the decorative lamp can then be controlled and switched among different working modes by the controller 5. However, it is to be appreciated that the transversely arranged, tail-to-end connected arrangement of the segmental light-emitting bodies 1 when installed on the lawn as described in the present embodiment is only illustrative and explanatory. In practical use scenarios, the segmental light-emitting bodies may alternatively be arranged longitudinally or transversely or crisscrossed, without limitation.

It should be noted that the above-mentioned specific embodiments are exemplary, and those skilled in the art can come up with various solutions inspired by the disclosure of the present invention, and those solutions also fall within the disclosure scope as well as the protection scope of the present invention. It should be understood by those skilled in the art that the description of the present invention and the accompanying drawings are illustrative rather than limiting to the claims. The protection scope of the present invention is defined by the claims and their equivalents. The description of the present invention contains a number of inventive concepts, such as "preferably", "according to a preferred embodiment" or "optionally" all indicate that the corresponding paragraph discloses an independent idea, and the applicant reserves the right to file a divisional application based on each of the inventive concepts.

What is claimed is:

1. A segmental light-emitting body, comprising an elastically bendable transparent tube, a flexible strip light that includes a plurality of light-emitting cells, and a spring steel band that is integrally formed;

wherein the transparent tube radially wraps therein the strip light and the spring steel band that are arranged in parallel to each other, wherein the segmental light-emitting body is formed into an independent component in virtue of the transparent tube acting as its light-permeable housing, and wherein when the segmental light-emitting body is electrically connected to at least one another said segmental light-emitting body formed in the same way, the segmental light-emitting body is mechanically independent of the at least one another segmental light-emitting body, wherein the strip light and the spring steel band are movably received in the transparent tube, wherein each of two axially opposite ends of the transparent tube is capped by a cap that forms an electronic port and a mechanical port for the segmental light-emitting body, wherein the mechanical port serves to fix the segmental light-emitting body to a surface for carrying the segmental light-emitting body, and the electronic port serves to electrically connect the segmental light-emitting body to its upstream and/or downstream segment in parallel, wherein the transparent tube is formed as an optical component that reflects and refracts light emitted by the light-emitting cells, so that a plurality of spot-like light sources formed by the light-emitting cells arranged along an axial direction of the transparent tube lights up along the axial direction substantively the entire transparent tube, wherein the segmental light-emitting body has a lead terminated with a butt connector for electrically connecting the segmental light-emitting body to at least one another said segmental light-emitting body in series.

2. A bendable decorative lamp, at least comprising:

a plurality of segmental light-emitting bodies that are independent of each other, wherein each said segmental light-emitting body has an elastically bendable transparent tube, a flexible strip light having a plurality of light-emitting cells, and a spring steel band that is integrally formed, and the transparent tube radially wraps therein the strip light and the spring steel band that are arranged in parallel to each other, wherein the segmental light-emitting bodies are mechanically separated from each other and electrically connected to each other by at least one butt connector for electrically connecting each segmental light-emitting body to at least one another said segmental light-emitting body in series.

3. The decorative lamp of claim 1, further comprising an electronic control unit that is provided at one end of the plural mechanically independent segmental light-emitting bodies and has a power supply portion and a controller, wherein the power supply portion is configured to power the light-emitting cells of each said segmental light-emitting body in a parallel-connection manner; and the controller is configured to control each of the light-emitting cells electrically connected in parallel in each said segmental light-emitting body.

4. The decorative lamp of claim 1, wherein when the segmental light-emitting bodies are to be stored for transportation, the segmental light-emitting bodies can be spirally coiled.

5. The decorative lamp of claim 4, wherein the segmental light-emitting body composed of the transparent tube, the strip light having the light-emitting cells, and the spring steel band has a length of 0.5 m-3 m; and the transparent tube has a diameter that is greater than a diameter of the spring steel band, wherein the diameter of the transparent tube is 6 mm-10 mm, and the diameter of the spring steel band is 2 mm-4 mm.

6. The decorative lamp of claim 2, wherein the decorative lamp comprises a plurality of separate segmental light-emitting bodies, each of which can be electrically connected to its upstream and/or downstream segment through their respective ports for cascade connection while remaining mechanically separated from each other, wherein each said segmental light-emitting body comprises an elastically bendable transparent tube, a flexible strip light having a plurality of light-emitting cells, and a spring steel band that is integrally formed, and the transparent tube radially wraps therein the strip light and the spring steel band arranged in parallel to each other, wherein the segmental light-emitting bodies are such coiled and stored that the elastically bendable transparent tube and the spring steel band and the flexible strip light radially received therein can restore their initial shapes after being uncoiled.

7. A bendable and poseable decorative lamp, at least comprising:

a plurality of composite light-emitting bodies that are separate from each other such that they can be electrically connected to each other through their respective ports and mechanically independent of each other, wherein the composite light-emitting body at least comprises a transparent tube and a plurality of light-emitting cells, wherein the light-emitting cells are arranged on at least a part of a lead in the transparent tube along an extending direction of the lead, and wherein the transparent tube accommodates therein a shape-memory steel band enabling the composite light-emitting body to be bent and posed, wherein two ends of the transparent tube are each capped by a cap, wherein the cap is at least partially capped on the end of the transparent tube, and at an end of the cap remote from the transparent tube, a lead hole is provided for allowing the lead to pass therethrough and enter the transparent tube wherein the cap is terminated with a soil pin, wherein one end of the soil pin configured to face the ground is formed as a cone-shaped structure for fixing the composite light-emitting body to the ground, wherein on the surface of the soil pin at a side remote from the ground, a lead slot is provided for allowing the lead to pas therethrough and come out, wherein when the pin member is inserted into the lawn, the slot and the cap are remained above the ground, so as to prevent the lead from being buried underground and subject to conditions adverse to its transmission functions.

8. The decorative lamp of claim 7, wherein the lead and the shape-memory steel band are movably received in the transparent tube.

9. The decorative lamp of claim 7, wherein the shape-memory steel band enables each said composite light-emitting body, in a manner that it can be coiled and uncoiled to restore its original shape, to present an arched structure of a variable radian.

10. The decorative lamp of claim 7, wherein the lead is terminated with a butt connector for connecting at least one another said composite light-emitting body.

11. The decorative lamp of claim 7, further comprising a power source provided at an input end of the connected composite light-emitting bodies and powering the composite light-emitting bodies in a parallel-connection manner; and a controller for controlling working states of each composite said light-emitting body.

12. The decorative lamp of claim 7, wherein the transparent tube has a diameter that is greater than a diameter of the shape-memory steel band, and the transparent tube has a length that is greater than or equal to a length of the shape-memory steel band.

13. The decorative lamp of claim 12, wherein any two adjacent said light-emitting cells in the transparent tube are separated by an interval not greater than 10 cm, preferably not greater than 8 cm, and more preferably not greater than 5 cm.

* * * * *